United States Patent [19]

Wiley et al.

[11] Patent Number: 4,785,596

[45] Date of Patent: Nov. 22, 1988

[54] ATTIC VENT

[75] Inventors: Byron C. Wiley; Mary B. Wiley, both of Phoenix; James C. Luttrell, Scottsdale, all of Ariz.

[73] Assignee: Metal Products Company Incorporated, Phoenix, Ariz.

[21] Appl. No.: 67,161

[22] Filed: Jun. 29, 1987

[51] Int. Cl.[4] ..... E04B 1/70; E06B 7/08

[52] U.S. Cl. ..... 52/302; 52/473; 98/121.1

[58] Field of Search ..... 160/104; 52/473, 209, 52/302; 98/121.1, 121.2

[56] References Cited

U.S. PATENT DOCUMENTS

| | | | |
|---|---|---|---|
| 1,326,200 | 12/1919 | Johnson | 52/209 |
| 2,480,562 | 8/1949 | Ewing | 52/473 |
| 2,956,496 | 10/1960 | Simblest | 98/121.1' |

*Primary Examiner*—James L. Ridgill, Jr.

*Attorney, Agent, or Firm*—Cahill, Sutton & Thomas

[57] ABSTRACT

An attic vent is disclosed incorporating a seamless frame wall having an outer flange defining an outside diameter and having an inner flange defining an inside diameter; a plurality of louvers are mounted within the truncated cone formed by the frame wall. The louvers are parallel with respect to each other and are sloped to form parallel downwardly inclined louvers when the vent is mounted in place.

4 Claims, 1 Drawing Sheet

ATTIC VENT

BACKGROUND OF THE INVENTION

The present invention relates to vent apparatus, and more particularly to vents of the type that are positioned in dwelling walls to provide ventilation to an attic space.

Vents of the type to be used in openings in attics may take a variety of forms and shapes; however, they must all accomplish the same purpose. The vents must permit free air movement into and out of the attic space, must prevent the ingress of small animals or birds, and must prevent the entrance of rain. The opening provided by a typical vent clearly establishes a ventilation path for air entering and exiting the attic space; such vents characteristically include a screen or mesh for preventing ingress by animals and birds. Prevention of the intrusion of water in the form of rain is characteristically accomplished by louvers that extend across the vent and are generally sloped downwardly to drain the water.

The various prior art shapes of vents, such as round or rectangular, are formed with a frame usually constructed of metal; the frame is constructed having parallel opposite sides joined at the corners to form a parallelepiped. The louvers extend from one wall to an opposite wall. The difficulty with prior art vents relates to the undesirable collection of water along the lower frame wall. This collection of water results in rust which eventually creates an opening in the vent wall thus permitting water to enter the dwelling wall in which the vent is mounted. Further, such prior art vent structures require the assembly of numerous elements or parts which is time consuming and expensive.

OBJECTS OF THE INVENTION

It is therefore an object of the present invention to provide an attic vent with fewer parts and is therefore less expensive to manufacture.

It is another object of the present invention to provide an attic vent incorporating a sloped frame wall that inherently prevents the accumulation of moisture to avoid rust.

It is still another object of the present invention to provide an attic vent having fewer parts including a one piece seamless frame wall.

SUMMARY OF THE INVENTION

Briefly, in accordance with the embodiment chosen for illustration, an attic vent is formed having a frame wall in the shape of a truncated cone. The frame wall may be constructed utilizing spin forming techniques so that the frame is seamless with front and rear flanges, the front or outer flange defining an outside diameter and the rear or inner flange defining an inside diameter with the flanges positioned in parallel spaced-apart planes. The truncated cone structure of the frame wall thus permits the attachment of a plurality of louvers which are fixed or attached to the frame wall and slope downwardly to prevent the entrance of rain when the vent is positioned in an attic or ventilation space wall. The seamless frame wall formed into its truncated shape inherently provides an outwardly sloping surface to any moisture and does not present any corners or fabricated junctions to permit the accumulation of water.

BRIEF DESCRIPTION OF THE DRAWINGS

The present invention may more readily be described by reference to the accompanying drawings in which.

DETAILED DESCRIPTION OF THE PREFERRED EMBODIMENT

Figure 1:
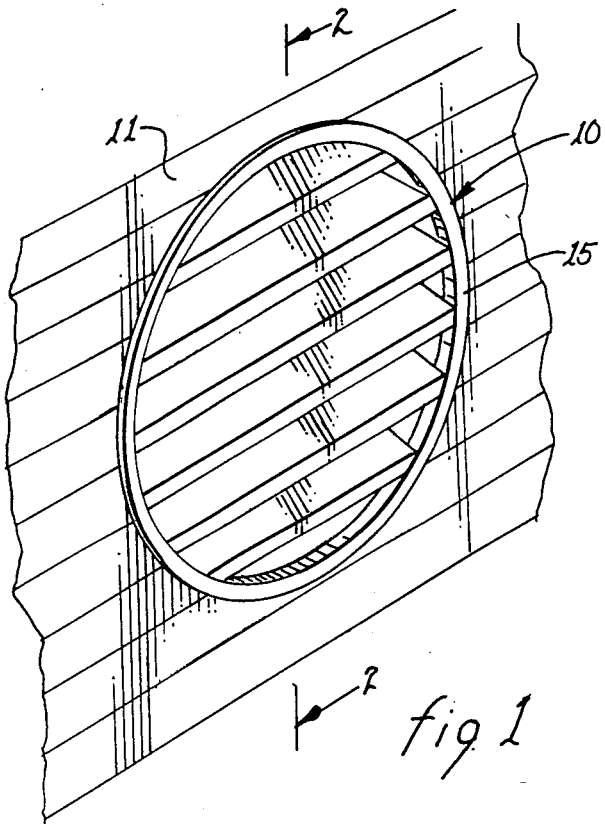
FIG. 1 is a perspective view of a attic vent constructed in accordance with the teachings of the present invention showing the vent mounted in an operative position.
Figure 2:
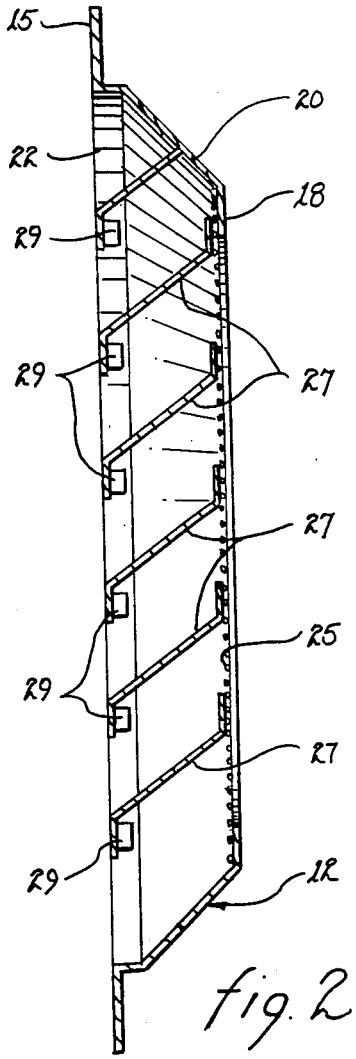
FIG. 2 is a cross-sectional view of the vent of FIG. 1 taken along line 2—2.
Figure 3:
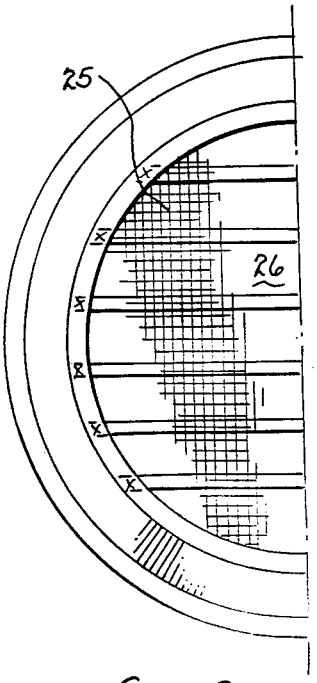
FIG. 3 is a rear elevational view of a portion of the vent of FIG. 1.
Figure 5:
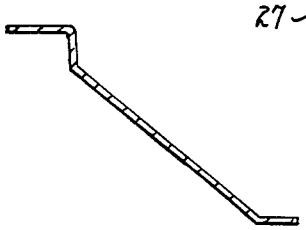
FIG. 5 is a cross-sectional view of the seamless frame wall of the vent of FIG. 1.
Figure 4:
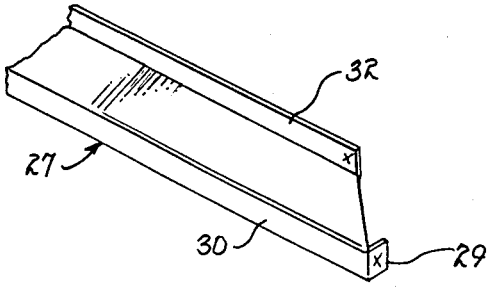
FIG. 4 is an isometric view of a portion of a louver of the vent of FIG. 1.

Referring now to the drawings, an attic vent 10 is shown mounted or positioned within a wall 11 to provide ventilation of the space behind the wall. The vent is constructed having a frame wall 12 formed, such as by spin forming, of a single piece of metal in a truncated cone form; the frame wall is seamless and is provided with an outer flange 15 that will normally abut the wall 11 to facilitate positioning of the vent it its operating position.

An inner flange 18 is provided to facilitate the attachment of louvers to the frame wall. The outer flange 15 and inner flange 18 are positioned respectfully in parallel spaced apart planes and are connected by the frame wall web 20. The truncated conical shape of the frame wall is interrupted by a cylindrical ledge 22 that provides a convenient surface for attachment of the louvers as will be described more fully hereinafter. The outer flange 15 defines an outside diameter while the inner flanges 18 defines an inside diameter; the outside diameter representing a function of the size of the hole necessary in the attic wall to accept the vent while the inside diameter is a function of the necessary ventilating area required to provide the required air flow for ventilation.

A screen 25 is positioned over the opening 26 formed by the inner flange. A plurality of louvers 27 extend across the vent within the truncated cone formed by the frame wall. The louvers are sloped with respect to the planes formed by the inner and outer flanges and are secured to the frame wall through the utilization of tabs 29 which may be spot welded to the cylindrical ledge 22 of the frame wall.

The tabs 29 are formed integrally with a first flange 30 on each of the louvers, the first flange 30 forms a "lip" that is both attractive and functional. This flanges helps to prevent rain from entering the attic space by shrouding a part of the opening while also adding strength to the respective louvers and avoiding the exposure of a sharp edge. A second flange 32 is provided on each louver which provides longitudinal support and strength for the louver while also providing a means to secure the inner or back poriton of the louver to the frame wall. The second flange may be attached such as by spot welding to the inner flange 18 of the frame wall.

The overall structure of the attic vent of the present invention is extremely strong and is formed of a single seamless frame wall having the respective louvers attached thereto. No other bracing, corner brackets, or supporting members are required and the fabrication of the vent requires only the attachment of the louvers and screen. The resulting structure is thus constructed in fewer steps with fewer parts and less expensively than prior art attic vents.

It is claimed:

1. An attic vent comprising:

(a) a seamless frame wall having an outer flange defining an outside diameter and having an inside edge defining an inside diameter smaller than said outside diameter, and formed into a truncated cone with the outer flange and inside edge respectively positioned in parallel spaced apart planes;

(b) a plurality of louvers mounted within the truncated cone formed by said frame wall, parallel with respect to each other, said louvers sloped with respect to said planes to form parallel downwardly sloping louvers extending across said truncated cone when said vent is mounted.

2. An attic vent comprising:

(a) a seamless frame wall having an outer flange defining an outside diameter and an inner flange defining an inside diameter, said outside diameter larger than said inside diameter, and formed into a truncated cone with the outer flange and inner flange respectively positioned in parallel spaced apart planes;

(b) a plurality of louvers mounted within the truncated cone formed by said frame wall parallel with respect to each other, said louvers sloped with respect to said planes to form parallel downwardly sloping louvers extending across said truncated cone when said vent is mounted.

3. The combination as set forth in claim 2 wherein each of said louvers includes a first flange secured to said frame wall adjacent said outer flange and having a second flange secured to said frame wall at said inner flange.

4. The combination as set forth in claim 2 including a screen member secured to said frame wall and extending across said louvers in a plane parallel to said spaced apart planes.

* * * * *